US008322319B2

(12) United States Patent
Nagado

(10) Patent No.: US 8,322,319 B2
(45) Date of Patent: Dec. 4, 2012

(54) CAM SHAFT PHASE VARIABLE DEVICE IN ENGINE FOR AUTOMOBILE

(75) Inventor: Masayasu Nagado, Hadano (JP)

(73) Assignee: Nittan Vavle Co., Ltd., Hadano-shi (JP)

( * ) Notice: Subject to any disclaimer, the term of this patent is extended or adjusted under 35 U.S.C. 154(b) by 13 days.

(21) Appl. No.: 13/125,070

(22) Filed: Apr. 20, 2011

(65) Prior Publication Data

US 2011/0226202 A1 Sep. 22, 2011

Related U.S. Application Data

(63) Continuation of application No. PCT/JP2008/069134, filed on Oct. 22, 2008.

(51) Int. Cl.
*F01L 1/34* (2006.01)

(52) U.S. Cl. ..... 123/90.17

(58) Field of Classification Search ..... 123/90.15, 123/90.17; 464/160, 161; 74/568 R
See application file for complete search history.

(56) References Cited

U.S. PATENT DOCUMENTS

| | | | | |
|---|---|---|---|---|
| 2003/0226532 | A1 | 12/2003 | Takenaka et al. | |
| 2011/0000450 | A1* | 1/2011 | Shiino et al. | 123/90.17 |
| 2011/0192365 | A1* | 8/2011 | Kameda et al. | 123/90.15 |
| 2012/0073532 | A1* | 3/2012 | Kameda et al. | 123/90.15 |

FOREIGN PATENT DOCUMENTS

| | | | |
|---|---|---|---|
| DE | 10317607 | A1 | 11/2003 |
| JP | 2003/0226532 | A | 1/2004 |
| JP | 2006/077779 | A | 3/2006 |
| JP | 3948995 | B2 | 7/2007 |
| WO | 2009/098752 | A1 | 8/2009 |

OTHER PUBLICATIONS

International Search Report of PCT/JP2008/069134, mailing date Dec. 2, 2008.
U.S. Appl. No. 12/811,634, filed Aug. 9, 2010.

* cited by examiner

*Primary Examiner* — Zelalem Eshete
*Assistant Examiner* — Daniel Bernstein
(74) *Attorney, Agent, or Firm* — Westerman, Hattori, Daniels & Adrian, LLP

(57) ABSTRACT

A cam shaft phase variable device of an engine in which the attachment angle of a crankshaft and a cam shaft is maintained securely without being shifted by disturbance torque. The device has a drive body of revolution having a tubular section and a guide groove of reducing diameter and rotating relatively to the cam shaft and being driven by a crankshaft, a control body of revolution rotating relatively to the drive body through a rotary operating force imparting means and having the outer circumferential surface supported by the inner circumferential surface of the tubular section, an eccentric circular cam rotating synchronously, a movable member for displacing the guide groove, a cam guide intersecting the central axis perpendicularly and displaced by the eccentric circular cam, and an intermediate body of revolution displacing in the direction intersecting the cam guide perpendicularly while being supported on, and rotating integrally with, the camshaft.

2 Claims, 8 Drawing Sheets

(a)

(b)

CAM SHAFT PHASE VARIABLE DEVICE IN ENGINE FOR AUTOMOBILE

TECHNICAL FIELD

This invention relates to a phase varying device for use with an automobile engine equipped with a camshaft and a coaxial torque means for rotating a rotary drum in the forward or backward direction relative to the crankshaft of the engine so as to advance or retard the rotational phase of the camshaft relative to the crankshaft, thereby varying the valve timing of the engine. The relative rotational direction of the camshaft to advance/retard the phase angle thereof will be referred to phase advancing/retarding direction.

BACKGROUND ART

There has been known a valve timing control device for an automobile engine as disclosed in Patent Document 1 cited below. The device of Patent Document 1 has a drive plate 3 rotatably mounted on a camshaft 1 of the device and driven by the crankshaft of the engine; a driven shaft member 9 integrally mounted on the camshaft 1 and having on the periphery thereof a conversion guide 11 spaced apart at a distance from the front end of the drive plate 3; and an intermediate rotor 5 rotatably mounted on the driven shaft member 9 via a bearing 14 ahead of the conversion guide 11.

Each of the drive plate 3, driven shaft member 9, and intermediate rotor 5 is provided with radial guides 10 in the form of radial grooves, guide bores 12 skewed with respect to the circumference, a spiral guide 15, and balls 16 that can roll in the guides (10, 12, 15). The intermediate rotor 5 is rotated relative to the driven shaft member 9 as the yoke 19 integrated with the intermediate rotor 5 is driven by magnetic forces exerted by electromagnetic coils 22*a* and 22*b*.

In the device of Patent Document 1, as the intermediate rotor 5 is rotated relative to the driven shaft member 9 by magnetic forces in the phase retarding direction, the balls 16 roll in the spiral guide 15 and is displaced radially inwardly in the respective radial guides 10, thereby performing a cam action on the conversion guide 11, which in turn causes the driven shaft member 9 integral with the camshaft 1 to be advanced in phase relative to the drive plate 3. On the other hand, as the intermediate rotor 5 is rotated in the phase advancing direction relative to the driven shaft member 9 under the magnetic forces, the balls 16 roll in the respective guides 15, 10, and 11 in the opposite direction, performing a cam action on the conversion guide 11 in the opposite direction to retard the phase of the driven shaft member 9 relative to the drive plate 3.

DISCLOSURE OF THE INVENTION

Problems to be Solved by the Invention

In the Patent Document 1, the camshaft in operation is subjected to external disturbing torques arising from valve spring reactions. In the device of Patent Document 1, the balls 16 tend to roll in the guide bores 12 under a disturbing torque, and hence the disturbing torque is likely to invite an erroneous phase variation between the drive plate and camshaft and hence incorrect intake/exhaust valve timing.

In view of such problem as mentioned above, the inventors of the present invention were directed to provide a phase variable device for automobile engine equipped with a self-locking structure for immovably locking the members that correspond to the camshaft and drive plate of Patent Document 1 even under disturbing torques. The device has been filed as an International Patent Application, PCT/JP2008/51763, which will be referred to as Prior Application 1.

The phase variable device of Prior Application 1 is provided with an intermediate rotor 33 integral with the camshaft 30 (connected to center shaft 32), a first rotor 31 (corresponding to the drive plate 3 of Patent Document 1), and a second rotor 35, both rotated by the crankshaft. In the phase variable device of Prior Application 1, when the second rotor 35 is acted upon by a torque exerted by an electromagnetic clutch 34 (coil spring 59), the first circular eccentric cam 53 of a circular eccentric cam 36 slides in an elongate bore 56. As a consequence, a cam guide plate 37 is moved together with slide pins 40 along the guide pins (48-51) provided at the opposite ends of the elongate bore 56 in the direction perpendicular to the rotational axis L1 of the camshaft. As the slide pins 40 are displaced in the radially decreasing oblique guides 39 formed in the first rotor 31, the camshaft 30 and intermediate rotor 33 rotate relative to the first rotor 31 (coupled to the crankshaft), which causes the phase of the camshaft relative to the crankshaft to change.

On the other hand, the self-locking structure of Prior Application 1 is configured as follows: Firstly, when the camshaft 30 is acted upon by an external disturbing torque exerted by a valve spring, the intermediate rotor 33 is rotated by the torque relative to the first rotor 31. Since in this instance the slide pins 40 are acted upon by forces exerted by the respective oblique guides 39, the cam guide plate 37 is subjected to a force acting in the direction perpendicular to the rotational axis L1. As the first circular eccentric cam 53 is subjected to a force exerted by the elongate bore 56, and as a second circular eccentric bore 52 is subjected to a force exerted by a second circular eccentric cam 54 integral with the first circular eccentric cam 53, the second rotor 35 is acted upon by a force acting in the direction perpendicular to the rotational axis L1.

As a consequence of the external disturbing torque applied to the camshaft 30, the circumference 35*a* of the second rotor 35 comes into touch with the inner circumference 33*d* of the cylindrical section of the intermediate rotor 33, and gives rise to a frictional force between them. This frictional force automatically brings the second rotor 35 and intermediate rotor 33 in a mutually unrotatable locked condition (such locking hereinafter referred to as self-locking).

Thus, the self-locking structure of Prior Application 1 maintains the second rotor 35 and intermediate rotor 33 mutually unrotatable under an external disturbing torque, thereby prohibiting any phase error between the camshaft and the crankshaft.

However, in the phase variable device of Prior Application 1, the second rotor 35 is in contact with the interior of the intermediate rotor 33 and the circular eccentric cam 36 is rotatably mounted, via a circular bore 55, on the cylindrical section 32*d* formed at the leading end of the center shaft 32 (which is integral with the camshaft 30).

As a consequence, in the phase variable device of Prior Application 1 under an external disturbing torque, the cam guide plate 37 is subjected to a force in the direction perpendicular to the rotational axis L1. The force is transmitted to the first circular eccentric cam 53, which may cause the circular hole 55 of the first circular eccentric cam 53 to come into contact with the cylindrical section 32*d* and generate a torque that acts on the first circular eccentric cam 53 as well as on the second circular eccentric cam 54 integral with the first circular eccentric cam 53 before a local friction is generated between the outer circumference of the second rotor 35*a* and the inner circumference 33*d* of the intermediate rotor 33. If such a torque acts on the second circular eccentric cam 54, the second rotor 35 is subjected to a force exerted by the second circular cam 54 in the rotational direction.

In other words, in the device of Prior Application 1, if an external disturbing torque is applied to the second rotor 35, a local friction is not promptly generated, or only a negligible local friction takes place, between the second rotor 35 and intermediate rotor 33. As a consequence, in the device of the Prior Application, the self-locking function does not properly take place, thereby resulting in a possible phase error between the camshaft 30 and first rotor 31.

On the other hand, the force exerted to the second rotor 35 has a component in the direction perpendicular to the rotational axis L1. This component is transmitted to the first contact point where the elongate bore 56 comes into contact with the first circular eccentric cam 53, and further to the center axis L3 of the first circular eccentric cam 53. The force is further transmitted to the center axis L2 of the second circular eccentric cam 54 and results in a friction at the point where intermediate rotor 33 is in contact with the inner circumference 33*d*. (Such contact point where friction takes place will be referred to as point of action). This frictional force furnishes self-locking function.

The magnitude of the torque of the above-mentioned frictional force is given by $\mu$*Fcosq, where F is the component of the force acting on the above-mentioned first contact point in the direction towards the point of action (where the frictional force takes place), q is the angle (referred to as friction angle) between the force F and the line connecting the rotational axis L1 and the point of action, and $\mu$ is the coefficient of friction. This frictional force increases with decreasing friction angle q. Thus, in the device of Prior Application 1, in order to furnish a large frictional force for the self-locking function, the eccentric radius d1 of the second circular eccentric cam 54 be set smaller than the eccentric radius d2 of the first circular eccentric cam 53.

However, since the circular eccentric cam 36 consists of the first and second circular eccentric cams (53 and 54) integrated together, it has a rather complex configuration. Further, the second rotor 35 and circular eccentric cam 36 are supposedly separate members that the second circular eccentric cam 54 and circular eccentric bore 52 must be manufactured at a high precision. Thus, the device of the Prior Application disadvantageously requires many costly parts.

In view of the problems pertinent to Prior Application 1, it is an object of the present invention to provide an improvement in a phase variable device for an automobile engine: the improvement lying in enhancement of the self-locking structure such that an inadvertent phase error between the crankshaft and the camshaft will be prevented if an external disturbing torque is transmitted to the camshaft.

Means for Solving the Problem

To achieve the object above, the present invention provides a phase variable device for an automobile engine, comprising:

a cylindrical section;

a drive rotor having curved guide slits each extending in the circumferential direction of the cylindrical section with the radii thereof continuously decreasing, the drive rotor being rotatable relative to the camshaft and driven by the crankshaft of the engine;

a control rotor having an outer circumference in contact with, and supported by, the inner circumference of the cylindrical section, the control rotor driven by a torque means for rotation relative to the drive rotor;

a circular eccentric cam rotatable about the center axis of the camshaft in synchronism with the control rotor;

movable members in engagement with, and movable in, the respective guide slits; and an intermediate rotor having a cam guide in the form of a groove that extends in the direction perpendicular to the center axis of the camshaft to allow the circular eccentric cam to slide therein, the intermediate rotor being mounted on the camshaft such that the intermediate rotor is rotatable together with the camshaft but movable in the direction perpendicular to the camshaft.

Under a given initial condition, the control rotor rotates together with the intermediate rotor which is integral with the camshaft and with the drive rotor driven by the crankshaft. The control rotor is rotated by the torque means relative to the camshaft. The phase angle of the camshaft (or intermediate rotor) relative to the crankshaft (or drive rotor) may be varied in the phase advancing direction (which is the rotational direction of the drive rotor) or in the phase retarding direction (which is the direction opposite to the rotational direction of the drive rotor) in accordance with the direction of the relative rotation of the control rotor.

In other words, as the control rotor is put in a relative rotation, the circular eccentric cam slides in the cam guide. At the same time, the intermediate rotor and the movable member are moved in the direction perpendicular to the longitudinal direction of the cam guide. The phase angle of the camshaft relative to the crankshaft is varied by the displacement of the movable member in the curved guide slits and the resultant relative rotation of the intermediate rotor relative to the drive rotor. On the other hand, if an external disturbing torque is transmitted from a valve spring to the camshaft, the movable member and the intermediate rotor are acted upon by a force, via the curved guide slits, in the direction perpendicular to the longitudinal direction of cam guide. This force is transmitted from the cam guide to the circular eccentric cam and further therefrom to the control rotor, so that the control rotor is slightly displaced in the direction perpendicular to the longitudinal direction of the cam guide. As a consequence, the circumference of the control rotor is pushed against the inner circumference of the cylindrical section of the drive rotor, thereby giving rise to a local frictional force. That is, the phase variable device of the present invention automatically sets up the drive rotor and the control rotor in mutually immovable condition, thereby rendering the crankshaft (drive rotor) and camshaft (intermediate rotor) locked together without causing any phasic error between them.

On the other hand, since the circumference of the control rotor is supported by the inner circumference of the cylindrical section of the drive rotor, it is not necessary to mount the control rotor on the camshaft. Thus, the camshaft and the control rotor can be spaced apart and not in contact with each other, so that the control rotor is not subjected to a rotational force that arises from an external disturbing torque. As a result, a local frictional force takes place promptly between the control rotor and the drive rotor.

In achieving the object mentioned above, the circular eccentric cam of the phase variable device may be integrated with the control rotor.

By integrating the circular eccentric cam with the control rotor, the force exerted by the cam guide to the circular eccentric cam at their contact point (point of effort) has a component that lies in the direction perpendicular to the common rotational axis (which is the common to the drive rotor, intermediate rotor, and control rotor) and acts on the point of contact (point of action) between the cam guide and the circular eccentric cam. The direction does not pass through the center axis of the circular eccentric cam. Thus, this force gives rise to a local frictional force at the point of contact between the circumference of the control rotor and the inner circumference of the cylindrical section of the drive rotor. In this case, the distance from the point of effort (contact point between the cam guide and the circular eccentric cam) to the point of action is longer as compared with the corresponding distance in the case where the direction of the component passes through the center axis of the circular eccentric cam. This implies that the friction angle is smaller in the former case. Accordingly, the phase variable device can operate with a smaller friction angle and gives rise to a larger local frictional force for self-locking function without using coaxial circular eccentric cams in combination as in Prior Application 1.

It is noted that, through integration of the control rotor and the circular eccentric cam, the phase variable device can have a simpler structure and less elements as compared with a multi-element device.

In the phase variable device of the present invention, a local frictional force caused by an external disturbing torque is promptly transmitted to the intermediate rotor 33 without being damped. As a result, the self-locking function can effectively prevent a phase error from occurring between the camshaft and crankshaft.

The phase variable device can have a still smaller friction angle and hence an enhanced local frictional force due to an external disturbing torque. As a result, the self-locking function of the device can effectively prevent a phase error from occurring between the camshaft and crankshaft. Further, the inventive device has a less number of simplified elements, and hence can be manufactured at a lower cost.

The invention will now be described in detail by way of example with reference to the accompanying drawings.

DETAILED DESCRIPTION

Figure 1:
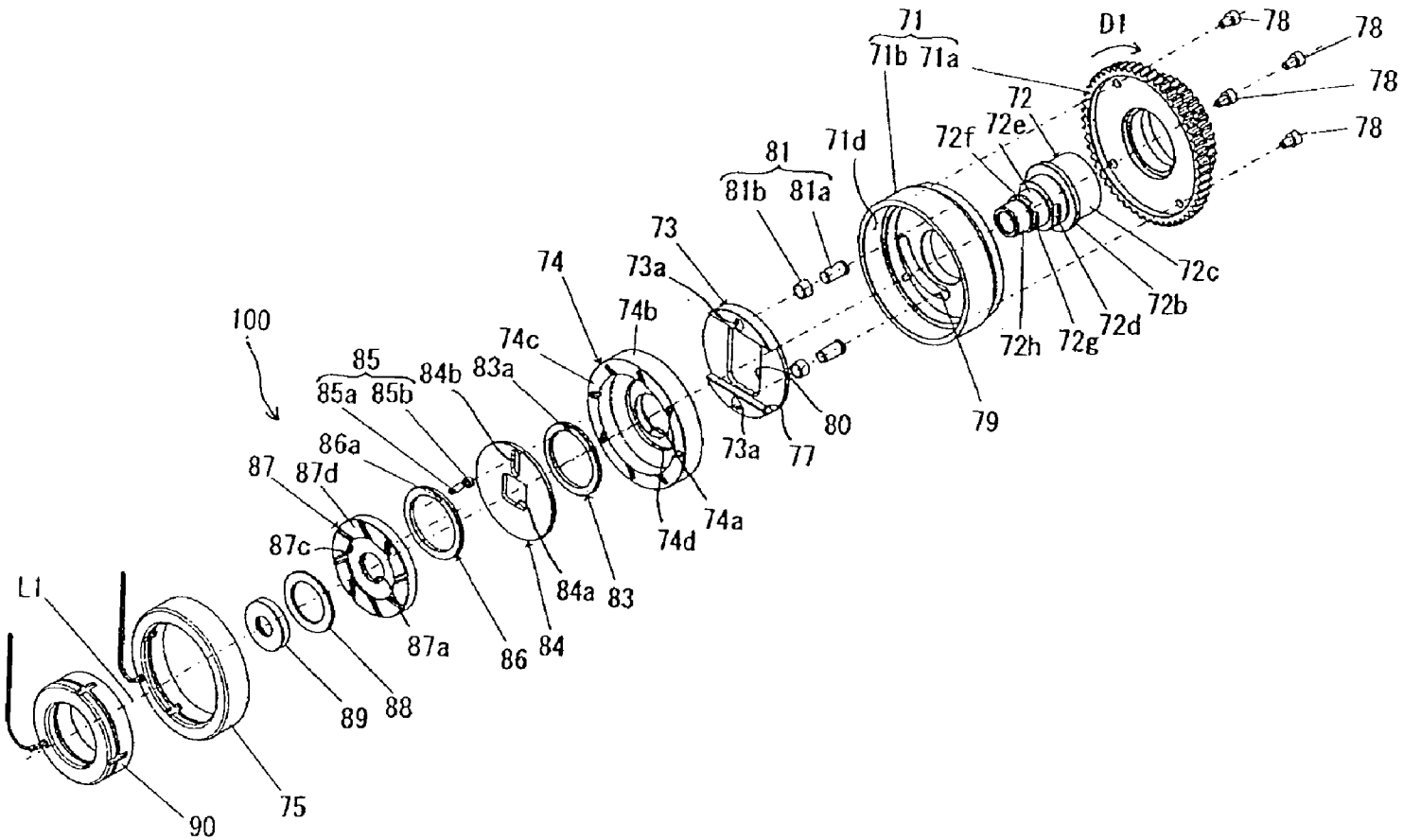
FIG. 1 is an exploded perspective view as seen from the front of a camshaft phase variable device for an automobile engine in accordance with an embodiment of the invention.
Figure 2:
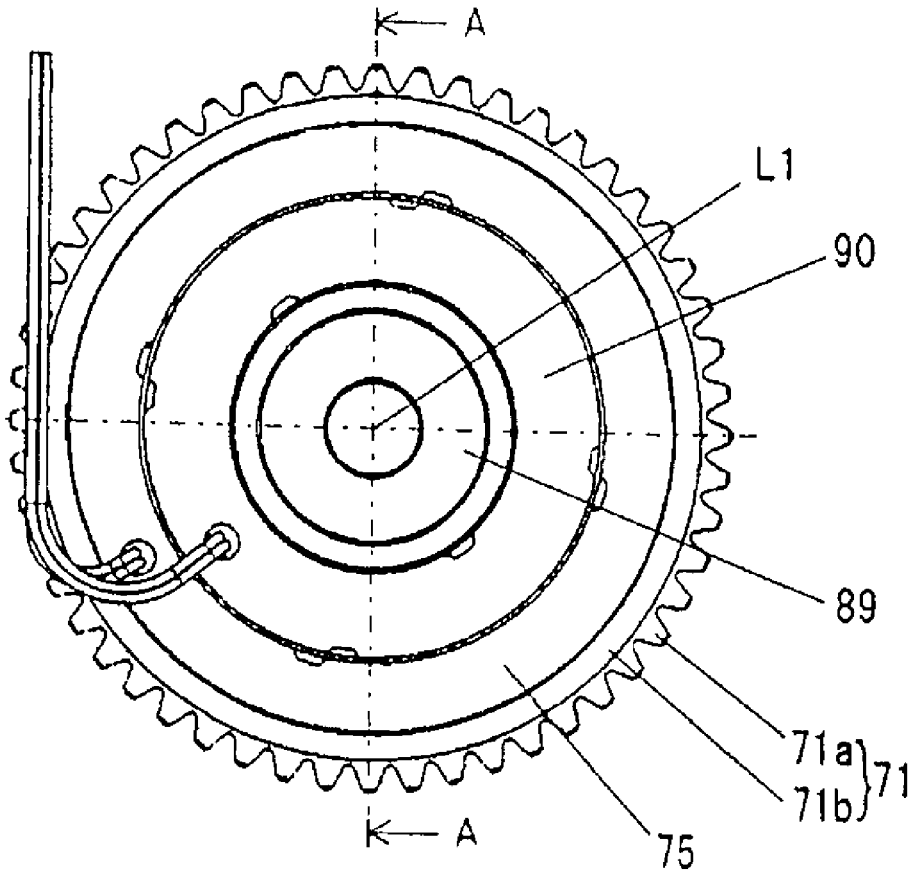
FIG. 2 is a front view of the device.

In use the camshaft phase variable device of the invention is installed integral with an internal combustion engine. The device is adapted to transmit the rotational motion of the crankshaft to a camshaft so as to open/close an intake valve/exhaust valve while varying the valve timing of the intake valve/exhaust valve in accordance with such operating conditions as the load and rpm of the engine.

Referring to FIGS. 1 through 8, there is shown a phase variable device in accordance with the first embodiment of the invention. For convenience, the term "front" section refers to the section of the device having a second electromagnetic clutch 90 (described in detail below), while the section having a sprocket 71*a* will be referred to as the "rear" section. The device is provided with: a drive rotor 71 driven by the crankshaft (not shown) of the engine; a center shaft 72 fixedly mounted on a coaxial camshaft (not shown) for rotatably supporting the drive rotor 71; an intermediate rotor 73 mounted on the center shaft 72 ahead of the drive rotor 71 such that the intermediate rotor 73 is unrotatable relative to the center shaft 72 but rotatable relative to the drive rotor 71; a first control rotor 74 (which is equivalent to the control rotor defined in claim 1) with its circumference supported by the drive rotor 71 such that the first control rotor 74 is rotatable relative to the center shaft 72 without touching the center shaft 72; and a first electromagnetic clutch 75 securely fixed to an engine casing (not shown), for braking the first control rotor 74, all aligned to the same rotational axis L1.

Figure 3:
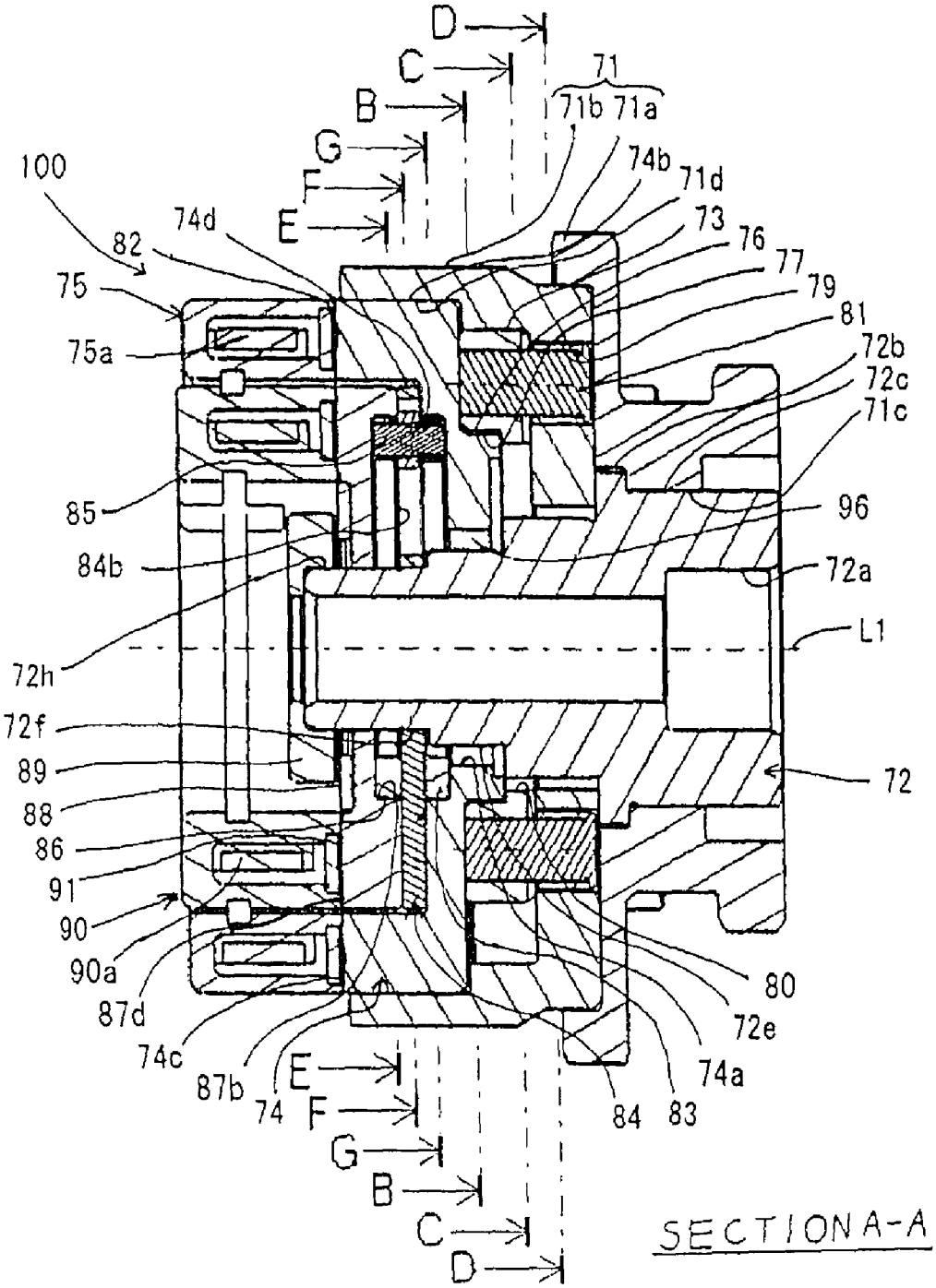
FIG. 3 shows the axial cross section of the device taken along line A-A of FIG. 2.
Figure 4:
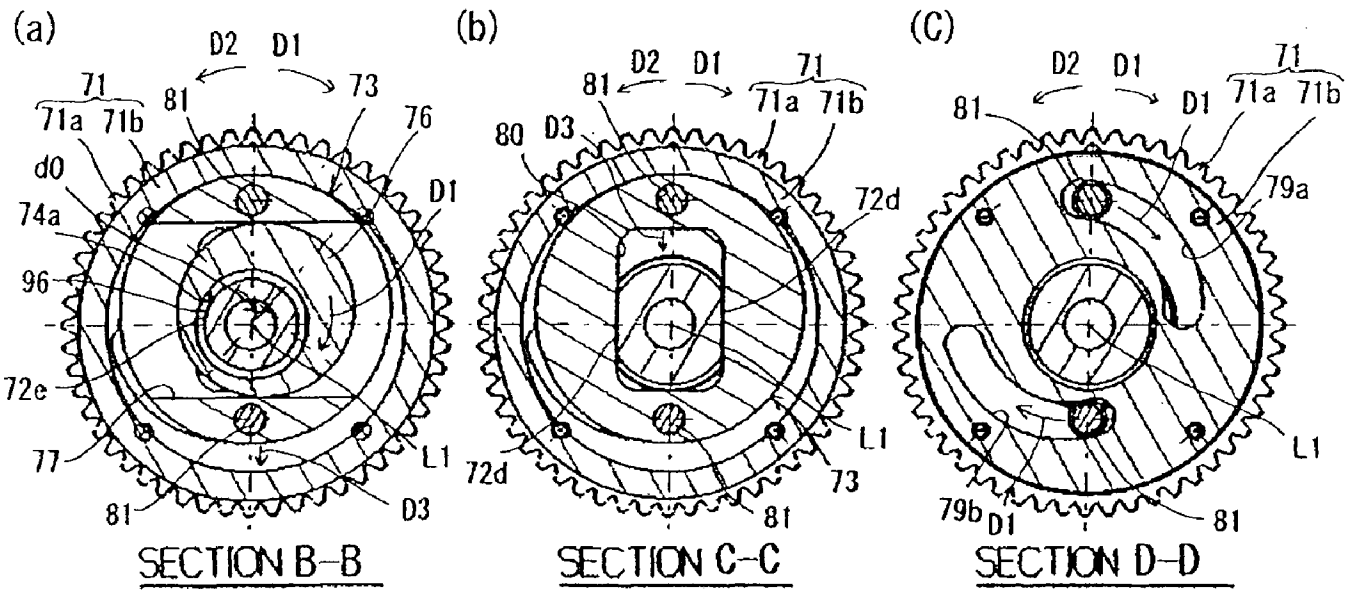
FIG. 4 shows radial cross sections taken at different axial positions of the device having no phase change. More particularly, FIG. 4(*a*) shows the cross section taken along line B-B, FIG. 4(*b*) the cross section taken along line C-C, and FIG. 4(*c*) the cross section taken along line D-D of FIG. 3.

The first control rotor 74 has on the backside thereof a circular eccentric cam 76 (FIGS. 3 and 4(*a*)) that rotates together with the control rotor 74 about the rotational axis L1. The intermediate rotor 73 is provided on the front end thereof with a cam guide 77 that receives thereon the circular eccentric cam 76. As the circular eccentric cam 76 rotates, the intermediate rotor 73 reciprocates in the direction perpendicular to both the rotational axis L1 and the wall of the cam guide 77.

The center shaft 72 unrotationaly coupled to the camshaft (not shown) by securely fixing the leading end of the camshaft in the bore 72*a* formed in the center shaft 72. The drive rotor 71 consists of a sprocket 71*a* and a drive cylinder 71*b* coupled together with a multiplicity of coupling pins 78. The drive rotor 71 is rotatably mounted on the cylindrical section 72*c* formed on the rear end of a flange 72*b* of the center shaft 72 by rotatably fitting the cylindrical section 72*c* in the hole 71*c* formed in the sprocket 71*a*. The drive cylinder 71*b* has a bottom having a guide slit system 79 consisting of a pair of curved guide slits 79*a* and 79*b* extending in substantially the circumferential direction about the rotational axis L1. As shown in FIG. 4, the guide slits 79*a* and 79*b* are formed in the opposite sides of the rotational axis, with their radii continuously decreasing towards the rotational direction D1 of the drive rotor 71 (clockwise direction D1 as viewed from front). It should be understood that the radially inwardly decreasing guide slit 79*a* can decrease its radius in the counterclockwise direction D2, as described later.

The first intermediate rotor 73 is generally a disk having a pair of faces perpendicular to the rotational axis L1. The first intermediate rotor 73 is provided on the front face thereof with a cam guide 77 adapted to receive thereon the circular eccentric cam 76. The cam guide 77 has a bottom face perpendicular to the rotational axis L1 and the sidewall thereof. The bottom face has a generally square elongate hole 80. The first intermediate rotor 73 is mounted on the flat engaging face 72*d* of the center shaft 72 unrotatably relative to the center shaft 72, but is supported by the center shaft 72 slidable in the longitudinal direction of the elongate hole 80.

The first intermediate rotor 73, first control rotor 74, and circular eccentric cam 76 are arranged inside the drive cylinder 71*b*. The first control rotor 74 is provided at the center thereof with a through-hole 74*a* for allowing the cylindrical section 72*e* of the center shaft 72 to pass through it without touching it.

The inner diameter of the through-hole 74*a* is larger than the outer diameter of the cylindrical section 72*e* of the center shaft 72. Between the cylindrical section 72*e* so as to provide an annular space 96 between the center shaft 72 and the cylindrical section 72*e*. The first control rotor 74 is slightly moved in the direction perpendicular to the rotational axis L1 by the self-locking structure, as described later. Thus, in order to prevent the cylindrical section 72*e* from touching the inner circumference of the through-hole 74*a* while moving, the space 96 is formed larger than the movable distance of the first control rotor 74. Then, under the self-locking condition, the first control rotor 74 touches the cylindrical section 72*e* without being subjected to a torque that causes rotation. As a consequence, the outer circumference 74*b* and the inner circumference 71*d* are securely self-locked.

The circular eccentric cam 76 integrally formed on the rear face of the first control rotor 74 has a center axis L2 offset from the rotational axis L1 by a distance d0. The first control rotor 74 is also a disk having an outer circumference 74*b*, which is set to be in substantial contact with, and supported by, the stepped inner circumference 71*d* formed inside the drive cylinder 71*b*.

Figure 6:
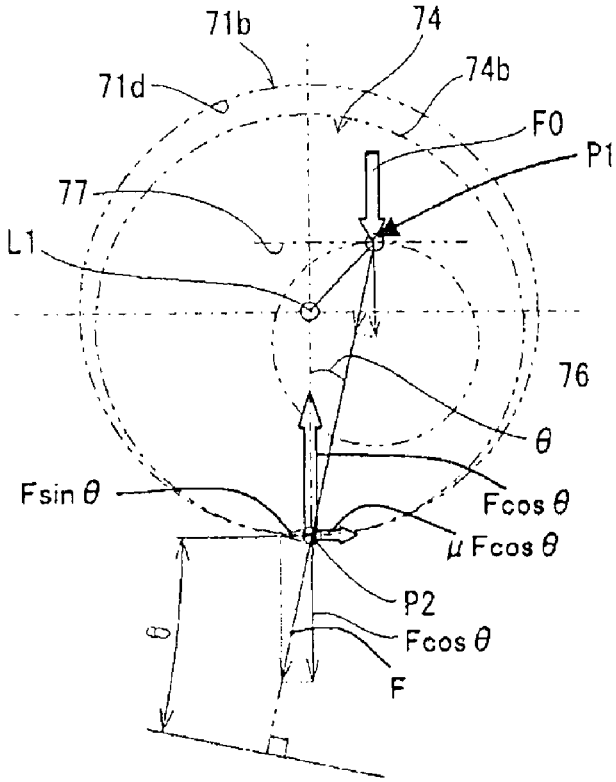
FIG. 6(*a*) illustrates a self-locking structure comprising a first control rotor and a drive rotor, and FIG. 6(*b*) shows another self-locking structure in which a first control rotor and another member constitute a circular eccentric cam.
Figure 6:
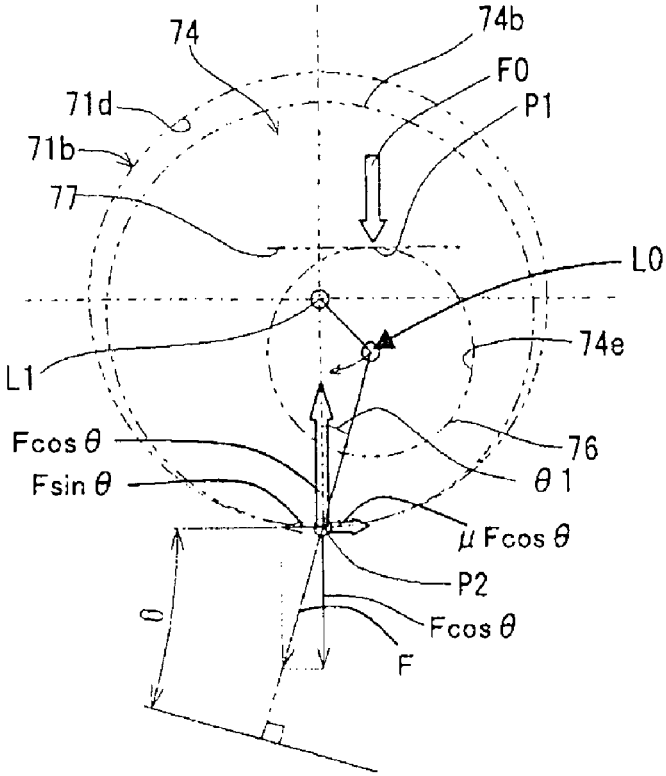
Figure 7:
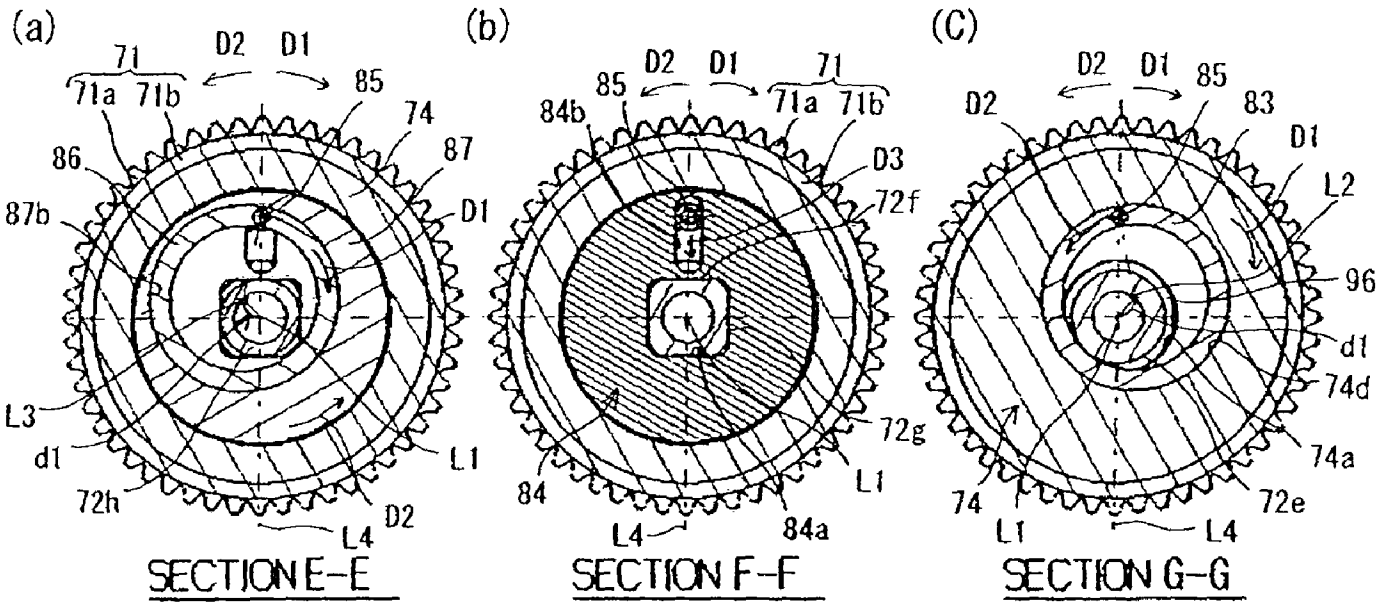
FIG. 7 shows radial cross sections of the device having no phase change. More particularly, FIG. 7(*a*) shows the cross section taken along line E-E of FIG. 3, FIG. 7(*b*) the cross section taken along line F-F of FIG. 3, and FIG. 7(*c*) the cross section taken along line G-G.
Figure 8:
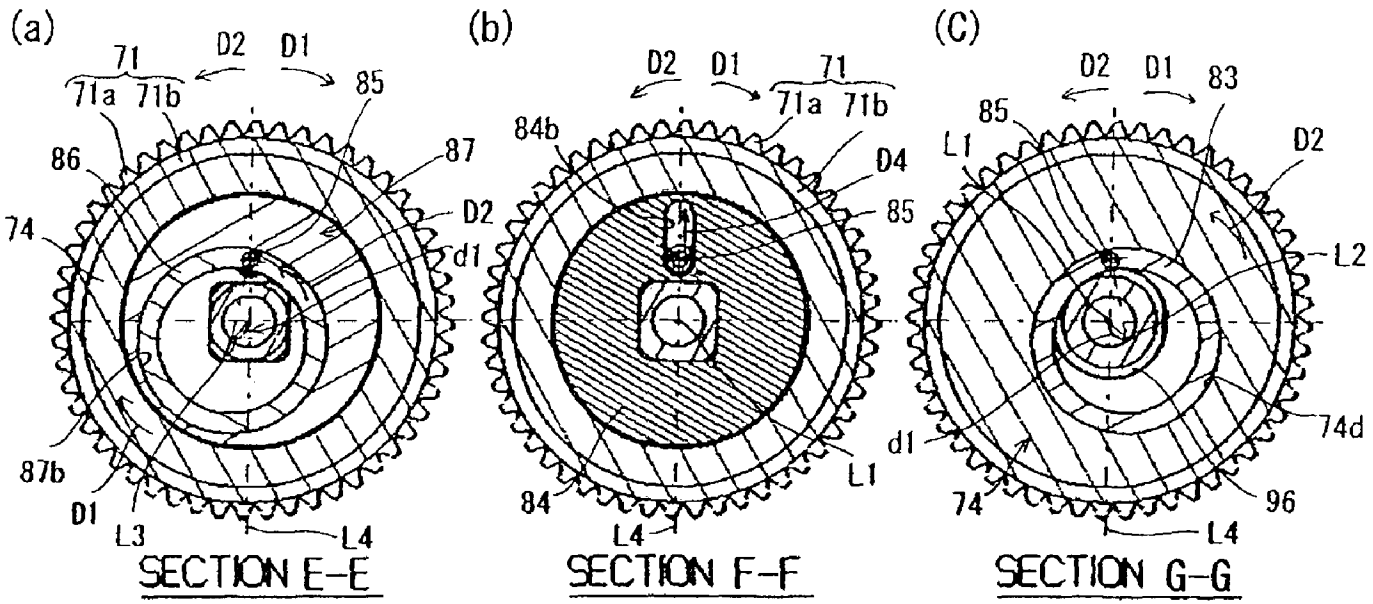
FIG. 8 shows cross sections taken along the same lines as in FIG. 6 of the device after a phase change has occurred.

The self-locking function that takes place between the first control rotor 74 and drive rotor 71 will now be described. The outer circumference 74*b* of the first control rotor 74 is in contact with, and supported by, the inner circumference 71*d* of the drive cylinder 71. The self-locking function arises from the local friction between the outer circumference 74*b* of the first control rotor 74 and the inner circumference 71*d* of the drive rotor 71*d* of the drive rotor 71. As shown in FIG. 6(*a*), when the camshaft (not shown) is subjected to a torque caused by an external disturbance, the circular eccentric cam 76 is subjected to a force acting on the point of effort P1 in the direction perpendicular to the extension line of the cam guide 77 and to the rotational axis L1 (the point of effort being the point where the circular eccentric cam 76 is in contact with the cam guide 77).

The first control rotor 74, which is integral with the circular eccentric cam 76, is moved by the force F0 until the outer circumference 74*b* comes into contact with the inner circumference 71*d* of the drive rotor 71*b* at the point of action P2. A force F acts on this point of action P2 in the direction from the point P1 to the point P2. Denoting by q the angle (referred to as friction angle) between the force F and the line L4 passing through the rotational axis L1 and the point of action P2, the component of F that causes the drive rotor 71 and the first control rotor 74 to rotate relative to each other and gives rise to a phase variation between the camshaft and the crankshaft equals Fsinq, as shown in FIG. 6(*a*). On the other hand, the reaction exerted by the drive cylinder 71*b* and acting on the first control rotor 74 equals Fcosq. Thus, assuming that the frictional coefficient between the outer circumference 74*b* and the inner circumference 71*d* is m, a local frictional force of mFcosq acts on the point of action P2. This frictional force furnishes the self-locking function. It is noted that the self-locking function does not take place unless the frictional force is larger than the force that causes the phase variation. In other words, the self-locking function becomes effective in the respective embodiments when the following condition is satisfied.

$$Fsinq<mFcosq$$

or if the friction angle q satisfies the condition $$q<\tan^{-1}m.$$

FIG. 6(*b*) illustrates a case where the circular eccentric cam 76 and the first control rotor 74 are separate members. When the circular eccentric cam 76 is slidably supported by the circular hole 74*e* formed in the first control rotor 74, the force F0 due to an external disturbing torque acts on the center axis L0 of the circular eccentric cam 76. In this case, the distance from the force of effect L0 to the point of action P2 is shorter than the distance from the point of effort P1 to the point of action P2, and the friction angle q is larger than that of the case where the circular eccentric cam 76 and first control rotor 74 are formed integral. Then the local frictional force is disadvantageously reduced in the former case (mFcosq1<mFcosq), which is not preferable for self-locking function. Therefore, it is preferred from the point of self-locking function to integrate the circular eccentric cam 76 and first control rotor 74 to reduce the friction angle q.

Thus, in the phase variable device of the first embodiment, the circular eccentric cam 76 and first control rotor 74 are integrated together, so that the point of effort P1 is located at the contact point between the cam guide 77 and the circular eccentric cam 76, instead of the center axis L0 of the circular eccentric cam 76. Accordingly, the self-locking function is enhanced as compared with Prior Application 1. It is noted that the profile of the circular eccentric cam 76 is not limited to a circle as in the present embodiment, but it may be of any cam configuration.

The first intermediate rotor 73 has a pair of movable members 81 extending rearward from a pair of engagement bores 73*a*. Each of the movable members 81 is formed of a thinner shaft 81*a* inserted in a thicker hollow cylindrical shaft 81*b*. The thinner shafts 81*a* engages the engagement bores 73*a*, while the thicker hollow cylindrical shaft 81*b* are movably fitted in a pair of substantially circumferential guide slits 79*a* and 79*b* formed in the drive cylinder 71*b*.

The first control rotor 74 is provided on the front end thereof with a torque means 100. The torque means 100 has a first electromagnetic clutch 75 for rotating the first control rotor 74 relative to the intermediate rotor 73 and drive rotor 71, and a reverse mechanism for rotating the first control rotor 74 in the reverse direction. The first electromagnetic clutch 75 is provided on the rear end thereof with a friction member 82, which is arranged to face the front end of the first control rotor 74. When the coil 75*a* of the electromagnetic clutch 75 is energized, the contact face 74*c* of the first control rotor 74 is brought into sliding contact with the friction member 82, thereby braking the rotational motion of the first control rotor 74.

The reverse mechanism includes a first ring member 83 disposed ahead of the first control rotor 74, second intermediate rotor 84, movable member 85, second ring member 86, second control rotor 87, shim 88, holder 89, and second electromagnetic clutch 90. Together with the first electromagnetic clutch 75, the reverse mechanism constitutes the torque means 100 of claim 1.

The first control rotor 74 is a generally hollow cylinder having a bottom, wherein the bottom has a stepped first circular eccentric bore 74*d* whose center axis L2 is offset from the rotational axis L1 by a distance d1. The first ring member 83 is slidably fitted in the circular eccentric bore 74*d*. The first ring member 83 has a first engagement hole 83*a*.

The second intermediate rotor 84 is provided at the center thereof with a square hole 84*a* and a substantially radial guide slit (hereinafter simply referred to as radial guide slit) 84*b* outside the square hole 84*a*. The second intermediate rotor 84 is securely fixed to the center shaft 72 by fitting the second flat engagement faces 72*f* and 72*g* of the center shaft 72 in the square hole 84*a*.

The second control rotor 87 is rotatably mounted on the center shaft 72 by fitting the small cylindrical section 72*h* formed at the leading end of the center shaft 72 in the circular hole 87*a* formed at the center of the second control rotor 87. The second control rotor 87 is provided in the rear end thereof with a stepped circular eccentric bore 87*b*, whose center axis L3 is offset from the rotational axis L1 by a distance d1 in a manner similar to the first circular eccentric bore 74*d*. Slidably fitted in the second circular eccentric bore 87*b* is the second ring member 86. The second ring member 86 is provided on the rear end thereof with a second engagement hole 86*a*.

The movable member 85 comprises a thin shaft 85*a* coaxially fitted in a thick hollow shaft 85*b*. The opposite ends of the thin shaft 85*a* are slidably fitted in the first and second engagement holes 83*a* and 86*a*, respectively. The thick hollow shaft 85*b* is movably fitted in the radial guide slit 84*b* of the second intermediate rotor 84.

The first and second ring members 83 and 86 are rotatably fitted in the first and second circular eccentric holes 74*d* and 87*b*, respectively, such that the center axes L2 and L3 of the first and second ring members 83 and 86, respectively, are located symmetrically across the phantom extension line L4 of the radial guide slit 84*b*.

The shim 88 is fitted in the stepped circular bore 87*c* formed in the front end thereof. A holder 89 is mounted on the small cylindrical section 72*h* of the center shaft 72 that protrudes forward from the circular hole 87*a*. Those elements arranged between the holder 89 and the drive cylinder 71*b* inclusive are securely fixed on the camshaft (not shown) by a screw inserted from front into the camshaft (not shown) through the central holes formed in these elements. The second electromagnetic clutch 90 is securely fixed to the engine casing (not shown) in front of the front end of the second control rotor 87. When the coil 90*a* of the second electromagnetic clutch 90 is energized, the contact face 87*d* of the front end of the second control rotor 87 is attracted onto the friction member 91 so as to brake the second control rotor 87 in rotation.

It is preferable to make the contact face 87*d* of the second control rotor 87 flush with the contact face 74*c* of the first control rotor 74 as shown in FIG. 3, since if the second control rotor 87 is disposed inside the coil 75*a*, the second control rotor 87 can be also magnetized and become instabilized by the first electromagnetic clutch 75 in braking operation.

The movable members 81 and 85 may be configured to have bearings or may be replaced by balls so that they can roll in the guide slit system 79 and in the radial guide slit 84*b* as they move. Then, the movable members 81 and 85 can move much easier with reduced friction, thereby saving electric energy consumed by the electromagnetic clutches.

The second intermediate rotor 84 is preferably made of a non-magnetic material. If the second intermediate rotor 84 is made of a non-magnetic material, it prevents the magnetic field attracting one of the control rotors 74 and 87 from being transmitted to the other control rotor via the second intermediate rotor 84, thereby preventing both of the control rotors from being attracted together.

Referring to FIG. 1 and FIGS. 4 through 8, operation of the camshaft phase variable device will be described for a case where the relative phase angle between the drive rotor 71 and the camshaft (not shown) is varied. When the drive rotor 71 is in phase with the camshaft (not shown) under the initial condition and rotates in the clockwise direction D1 as viewed from the front end of the device, the first intermediate rotor 73, control rotor 74 (circular eccentric cam 76), intermediate rotor 84, and control rotor 87 rotate together with the drive rotor 71 in the same clockwise direction D1.

To advance the phase angle of the camshaft (in the clockwise direction D1) relative to the drive rotor 71 the second control rotor 87 is braked by the second electromagnetic clutch 90. If the second electromagnetic clutch 90 is enabled, the first and second ring members 83 and 86, respectively, move from the positions shown in FIG. 7 to the positions shown in FIG. 8. Thus, the second control rotor 87 is retarded in phase, that is, rotated in the counterclockwise direction D2 (as viewed from the front end of the device), relative to the second intermediate rotor 84 and first control rotor 74. In that event, as the second ring member 86 slides in the circular eccentric bore 87*b* in D1 direction, the movable member 85 moves in the radial guide slit 84*b* radially inwardly (that is, in D3 direction as shown in FIG. 6(*b*)). As the movable member 85 moves radially inwardly in the radial guide slit 84*b*, the first ring member 83 exerts a torque on the first control rotor 74 in D1 direction while sliding in the first circular eccentric bore 74*d* in D2 direction. The first control rotor 74 rotates in the phase advancing direction (D1 direction) relative to the second intermediate rotor 84 and second control rotor 87.

At the same time, the first control rotor 74 rotates in D1 direction relative to the first intermediate rotor 73 and drive rotor 71, while the circular eccentric cam 76 integral with the first control rotor 74 eccentrically rotates in the clockwise direction D1 about the center axis L1 as shown in FIG. 4. As the circular eccentric cam 76 undergoes an eccentric rotation while sliding on the inner circumference of the cam guide 77, the first intermediate rotor 73 and movable members 81 move downward in the longitudinal direction D3 of the elongate square hole 80 as shown in FIG. 4.

Figure 5:
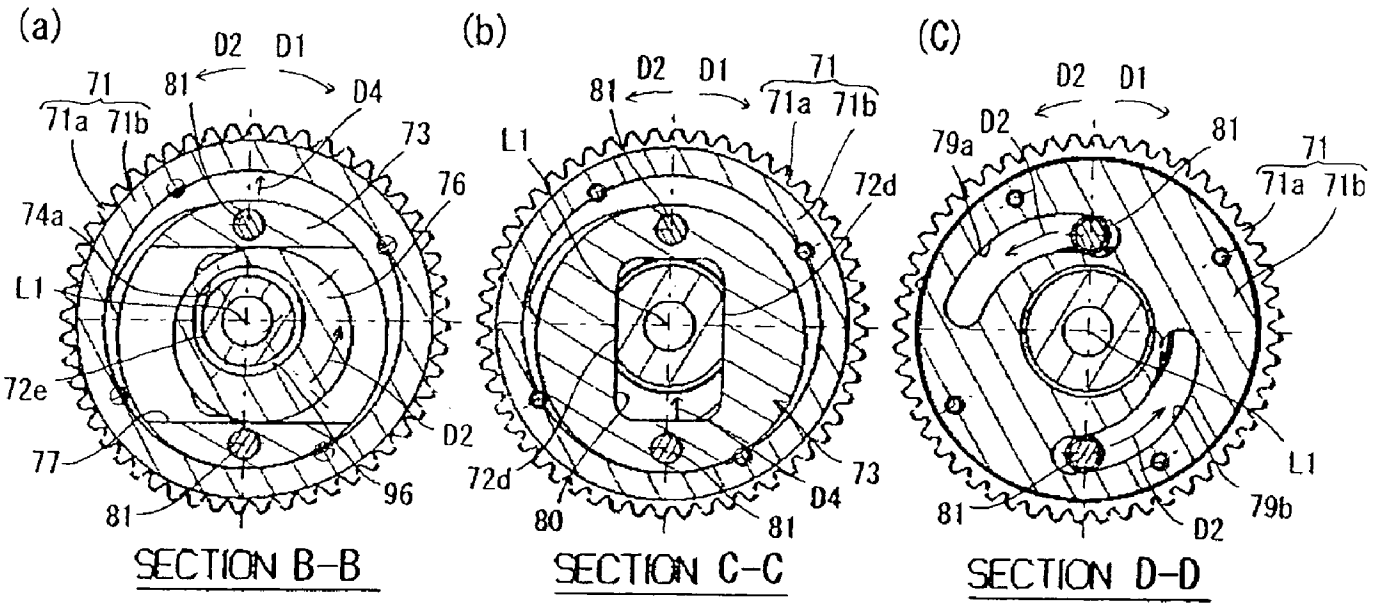
FIG. 5 shows cross sections of the device after a phase change has occurred, the cross section taken along the same lines as in FIG. 4.

As the movable members 81 go down, the first intermediate rotor 73 is displaced in the guide slits 79*a* and 79*b* in the D1 direction, so that the first intermediate rotor 73 is rotated in D1 direction relative to the drive rotor 71, thereby displaced from the position shown in FIG. 4 to the position shown in FIG. 5. As a consequence, the phase angle of the camshaft (not shown) in phase with the intermediate rotor 73 in rotation is advanced in D1 direction relative to the drive rotor 71.

On the other hand, to return the phase angle of the camshaft in the phase retarding direction D2 relative to the drive rotor 71, the first electromagnetic clutch 75 is activated to put the brake on the first control rotor 74. Then the circular eccentric cam 76 integral with the braked first control rotor 74 is rotated in the counterclockwise direction D2 relative to the drive rotor 71 and first intermediate rotor 73 as shown in FIG. 5, thereby moving the first intermediate rotor 73 and movable members 81 in the upward direction D4 as shown in FIG. 5. As the movable members 81 are moved upward, the first intermediate rotor 73 is displaced in the guide slit system 79 in D2 direction and hence rotated in D2 direction relative to the drive rotor 71, thereby returning from the position shown in FIG. 5 to the position shown in FIG. 4. As a consequence, the phase of the camshaft rotating in synchronism with the first intermediate rotor 73 is retarded in D2 direction relative to the drive rotor 71 driven by the crankshaft.

The invention claimed is:

1. A phase variable device for an automobile engine comprising:

a cylindrical section;

a drive rotor having curved guide slits each extending in the circumferential direction of the cylindrical section with the radii thereof continuously decreasing, the drive rotor being rotatable relative to the camshaft and driven by the crankshaft of the engine;

a control rotor having an outer circumference in contact with, and supported by, the inner circumference of the cylindrical section, the control rotor driven by a torque means for rotation relative to the drive rotor;

a circular eccentric cam rotatable about the center axis of the camshaft in synchronism with the control rotor;

a movable member in engagement with, and movable in, the respective guide slits; and an intermediate rotor having a cam guide in the form of a groove that extends in the direction perpendicular to the center axis of the camshaft to allow the circular eccentric cam to slide therein, the intermediate rotor being mounted on the camshaft such that the intermediate rotor is rotatable together with the camshaft and movable in the direction perpendicular to the camshaft.

2. The phase variable device according to claim 1, wherein the circular eccentric cam is integral with the control rotor.

* * * * *